US011365734B2

(12) United States Patent
Broglia et al.

(10) Patent No.: US 11,365,734 B2
(45) Date of Patent: Jun. 21, 2022

(54) POSITIVE-DISPLACEMENT COMPRESSOR HAVING AN AUTOMATIC COMPRESSION RATIO-ADJUSTMENT SYSTEM

(71) Applicant: SRM Italy S.r.l., Lonigo (IT)

(72) Inventors: Thomas Broglia, Rescaldina (IT); Enrico Faccio, Legnago (IT); Rujie Lin, Fujian (CN); Fabrizio Calgaro, Sarego (IT)

( * ) Notice: Subject to any disclaimer, the term of this patent is extended or adjusted under 35 U.S.C. 154(b) by 0 days.

(21) Appl. No.: 15/733,771

(22) PCT Filed: Apr. 24, 2019

(86) PCT No.: PCT/IB2019/053387

§ 371 (c)(1),
(2) Date: Oct. 21, 2020

(87) PCT Pub. No.: WO2019/207507

PCT Pub. Date: Oct. 31, 2019

(65) Prior Publication Data

US 2021/0131434 A1 May 6, 2021

(30) Foreign Application Priority Data

Apr. 26, 2018 (IT) ..... 102018000004880

(51) Int. Cl.
*F04C 18/16* (2006.01)
*F04C 28/16* (2006.01)
(Continued)

(52) U.S. Cl.
CPC ..... *F04C 18/16* (2013.01); *F04C 28/16* (2013.01); *F04C 28/12* (2013.01); *F04C 28/24* (2013.01); *F04C 2270/185* (2013.01)

(58) Field of Classification Search
CPC .... F04C 18/16; F04C 2270/185; F04C 28/12; F04C 28/16; F04C 28/24
See application file for complete search history.

(56) References Cited

U.S. PATENT DOCUMENTS 2,504,230 A * 4/1950 Smith ..... F04C 18/16 418/99
3,869,227 A * 3/1975 Kocher ..... F04C 28/24 418/15

(Continued)

FOREIGN PATENT DOCUMENTS

JP S62214293 9/1987

*Primary Examiner* — Mary Davis
(74) *Attorney, Agent, or Firm* — Themis Law

(57) ABSTRACT

A positive-displacement compressor having an automatic system for adjusting compression ratio and designed for installation in a conditioning or refrigeration system for a fluid includes a suction chamber for sucking the fluid with a variable suction pressure, a delivery chamber for delivering the fluid with a delivery pressure greater than the suction pressure, a compression chamber interposed between the suction chamber and the delivery chamber and communicating with the delivery chamber via one or more discharge ports, a compression element to compress the fluid to the compression pressure, a motor driving the compression element, and an adjusting system of the compression ratio. The adjustment system includes a mechanical valve interposed between the compression chamber and the delivery chamber that automatically varies discharge port apertures in response to a pressure differential between delivery chamber and compression chamber to instantaneously equalize compression and and delivery pressure and improve compressor efficiency.

9 Claims, 5 Drawing Sheets

(51) Int. Cl.
*F04C 28/12* (2006.01)
*F04C 28/24* (2006.01)

(56) References Cited

U.S. PATENT DOCUMENTS

| | | | |
|---|---|---|---|
| 4,946,362 | A | 8/1990 | Soederlund |
| 2011/0038747 | A1 | 2/2011 | Shoulders |
| 2012/0027632 | A1 | 2/2012 | Nemit |
| 2012/0227437 | A1 | 9/2012 | Nemit |
| 2014/0260414 | A1 | 9/2014 | Nemit |

* cited by examiner

POSITIVE-DISPLACEMENT COMPRESSOR HAVING AN AUTOMATIC COMPRESSION RATIO-ADJUSTMENT SYSTEM

FIELD OF THE INVENTION

The present invention generally finds application in the field of operating machines and particularly relates to a positive-displacement compressor having an automatic compression ratio-adjustment system, preferably but without limitation for use in conditioning and refrigeration systems.

BACKGROUND ART

Devices have been long known to be used in conditioning and refrigeration to compress a working fluid to change its pressure and hence its temperature.

These devices are generally known as positive-displacement compressors and comprise a suction chamber for sucking the working fluid, in fluid communication with a first portion of the system and a delivery chamber in fluid communication with a second portion of the system.

Furthermore, a compression chamber is interposed between the suction and delivery chambers, and has a discharge port adapted to establish fluid communication between the compression and the delivery chamber.

In order to change the pressure of the working fluid the compression chamber contains compression means driven by motor means.

The compression pressure of the working fluid, as measured at the discharge port must be substantially equalized with the delivery pressure to optimize the efficiency of the compressor and reduce the work to be done by the motor means.

Nevertheless, in positive-displacement compressors for conditioning and refrigeration the discharge port of the compression chamber has a fixed size which is selected according to a given rated operating condition of the system.

Therefore, as the operating state and, as a result, the delivery pressure required by the system change, the instantaneous compression ratio deviates from the nominal value.

In addition, due to the variations of the operating states of the system, the suction and delivery pressures are subject to oscillations that cause over-compression or under-compression, resulting in efficiency losses.

In an attempt to at least partially obviate these drawbacks, means have been developed for adjusting the flow rate of the compressor, which comprise a slide valve adapted to change the flow rate of the compressor by varying the size of the discharge port to change the compression ratio.

WO2011048618 discloses a positive-displacement compressor comprising double-screw compression means and a slide valve. The latter is placed between the compression means and the inner wall of the compression chamber and has one or more slits facing the compression means.

The slits are in fluid communication with the compression and discharge chambers, a plunger-operated shutter being located in the slide valve, to open or close the slits and accordingly change the compression ratio.

Furthermore, the shutter is electromechanically controlled by a plurality of valves external to the compressor, which are adapted to measure the compression and discharge pressures to control the translational movement of the shutter in the slide valve.

A first drawback of this arrangement is that the provision of the plurality of valves makes shutter position adjustment difficult and laborious, thereby increasing manufacturing costs.

A further drawback of this arrangement is that the plurality of valves increase the response times of the shutter as pressures are being read, with pressures varying quickly with time.

Another drawback of this arrangement is that in case of wrong pressure reading by the valves, adjustment is inefficient.

A further drawback is that the flow rate of the compressor is adjusted by connecting the motor means to an inverter to change the rpm of the compression means, resulting in increased complexity and costs of the compressor.

In an attempt to least partially obviate these drawbacks, compression ratio adjustment means have been developed which are independent of the flow rate adjustment means.

EP2436929 discloses a double screw expander comprising a plurality of movable elements moving in a plurality of bypass channels which are adapted to establish communication between the expansion chamber and the delivery and suction chambers and are independent of the flow-control slide valve.

The movable elements are controlled by means of a plurality of pilot-operated valves adapted to vary the pressure values at their ends to change their position in the channels and, as a result, the expansion ratio.

Nevertheless, once again the valves are externally controlled by a microprocessor control system which adds complexity to the device and does not afford instantaneous responses.

US2011038747, US2014260414 and US2012027632 disclose positive-displacement compressors having all the features of the preamble of claim 1.

Technical Problem

In the light of the prior art, the technical problem addressed by the present invention may be considered how to simply and inexpensively change the compression ratio of the compressor.

DISCLOSURE OF THE INVENTION

The object of the present invention is to solve the aforementioned technical problem by providing a positive-displacement compressor having an automatic compression ratio-adjustment system that is highly efficient and relatively cost-effective.

A particular object of the present invention is to provide a compressor as described hereinbefore that affords automatic and instantaneous change of the compression ratio.

A further particular object of the present invention is to provide a compressor as described hereinbefore that can change the compression ratio independently of flow rate control.

Another object of the present invention is to provide a compressor of as described hereinbefore that has a simple construction and can adjust the compression ratio without the help of external control and adjustment systems.

A further object of the present invention is to provide a compressor as described hereinbefore that can adjust the compression ratio while maintaining optimal efficiency with time.

These and other objects, as more clearly explained below, are fulfilled by a displacement compressor having an automatic compression ratio-adjustment system, which is designed to be installed in a working fluid conditioning or refrigeration system as defined in claim 1, said compressor comprising a suction chamber for sucking the working fluid, having a variable suction pressure in response to system conditions, a delivery chamber for delivering the working fluid, having a delivery pressure greater than the suction pressure and varying according to system conditions, and a compression chamber interposed between the suction chamber and the delivery chamber and in fluid communication with the latter via one or more discharge ports.

The positive-displacement compressor further comprises at least one screw compression element held within the compression chamber and rotating about a longitudinal axis to compress the fluid to a compression pressure, motor means for driving the at least one compression element and adjustment means for adjusting the compression ratio.

The adjustment means comprise mechanical valve means interposed between the compression chamber and the delivery chamber to automatically vary the aperture of the at least one discharge port according to the difference in pressure existing between the delivery chamber and the compression chamber.

According to a peculiar aspect of the invention, the compression chamber has a substantially flat end wall, transverse to the axis of rotation of the at least one compression element to define a delivery plane and the at least one seat is adjacent to the delivery plane for the movement of the at least one movable element to instantaneously equalize the compression pressure with the delivery pressure to improve the efficiency of the compressor.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a positive-displacement compressor having an automatic compression ratio-adjustment system, which is described as a non-limiting example with the help of the annexed drawings, in which.

DETAILED DESCRIPTION OF A PREFERRED EXEMPLARY EMBODIMENT

Figure 1:
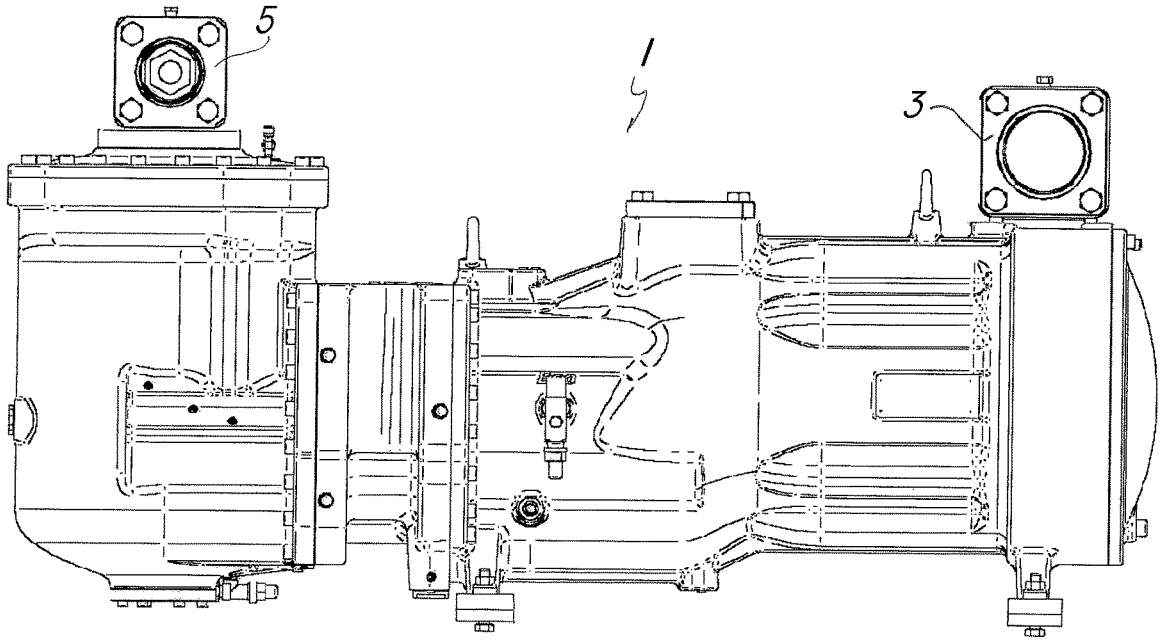
FIG. 1 is a side view of a positive-displacement compressor of the invention.

Particularly referring to the aforementioned figures, there is shown a positive-displacement compressor with a compression ratio adjustment system, generally designated by numeral 1, designed to be installed in a conditioning or refrigeration system for a working fluid F.

The compressor 1 can operate with any working fluid F, generally in gaseous state at ambient conditions.

The compressor 1 comprises a suction chamber 2 for sucking the working fluid F, having a suction pressure $p_a$ varying according to system conditions.

As is known per se, the suction chamber 2 is in fluid communication with a suction pipe, not shown, via a first flange 3 and the suction pipe is connected to a first region of the system.

Furthermore, the compressor 1 comprises a delivery chamber 4 for delivering the fluid F having a delivery pressure $p_m$ greater than the suction pressure $p_a$, and also varying according to system conditions.

Figure 2:
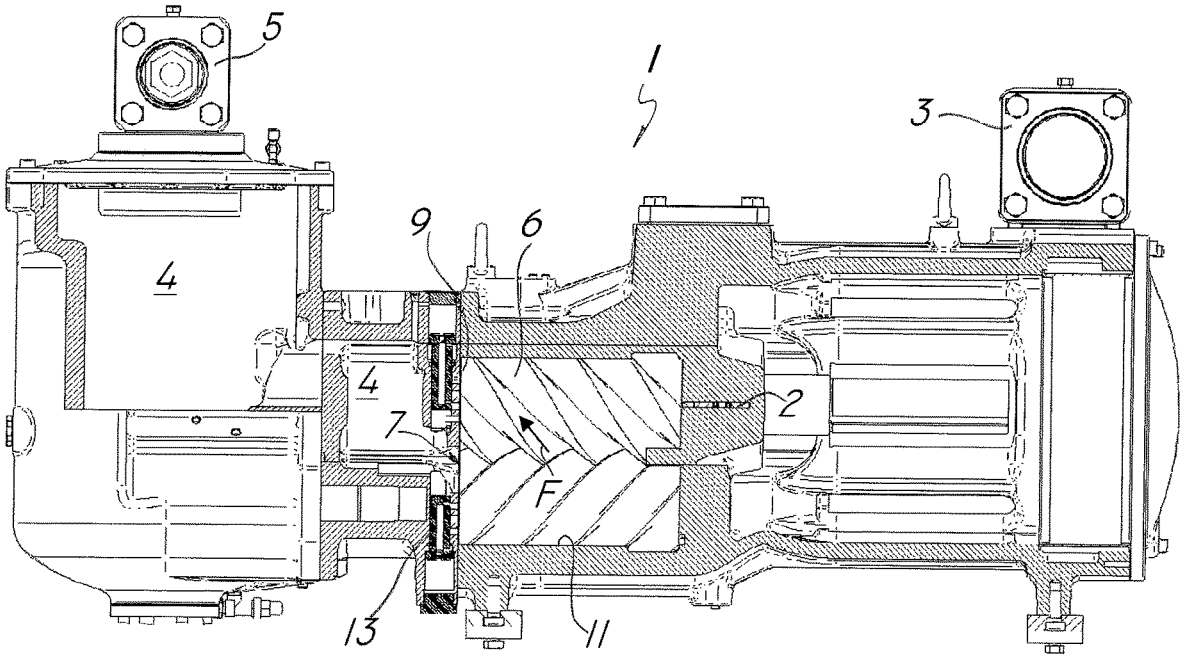
FIG. 2 is a longitudinal broken-away view of the positive-displacement compressor of FIG. 1.

As shown in FIGS. 1 and 2, the delivery chamber 4 is in fluid communication with a delivery pipe, not shown, via a second flange 5 and the delivery pipe is connected to a second region of the system.

As is known per se, a compression chamber 6 is interposed between the suction chamber 2 and the delivery chamber 4 and is in fluid communication with the delivery chamber 4 via one or more discharge ports 7.

In particular, the discharge ports 7 may comprise a primary discharge port 7', which is constantly open and in direct fluid communication with the delivery chamber 4 and one or more secondary discharge slits 7".

At least one screw compression element 8 is housed in the compression chamber 6 and rotates about a longitudinal axis X to compress the working fluid F to a compression pressure $p_c$, greater than the suction pressure $p_a$.

As shown in FIG. 2, the compressor 1 may comprise a pair of screw elements 8', 8" rotating about respective parallel longitudinal axes of rotation $X_1$, $X_2$ and having mating peripheral helical surfaces 10', 10" having the same or different diameters.

Advantageously, the primary discharge port 7' is defined by the contact of the profiles of the peripheral helical surfaces 10', 10" of the screws 8', 8".

The compression elements 8 may be male screws 8' or female screws 8" and may have predetermined diameters, respectively a greater diameter for the male element 8' and a smaller diameter for the female element 8", and opposite rotation directions.

Thus, the pair of screws 8', 8" and the inner wall 12 of the compression chamber 6 may create together a cavity 12 having a progressively decreasing volume, which is adapted to contain a certain amount of working fluid F which progressively moves between the suction chamber 2 and the delivery chamber 4 while reducing its volume and increasing its pressure.

In addition, the positive-displacement compressor 1 comprises motor means, not shown, for driving the element 8 or the compression elements 8', 8", and which may be commonly available electric means configured to set a rotation speed with a number of revolutions and a rate that are constant over time.

The two suction 2 and delivery 4 chambers have respective volumes V, $v_m$ defining an inherent compression ratio $V_i$, which is variable and adjustable using means for adjusting the compression ratio $v_i$.

As is known per se, the inherent compression ratio is given by the known formula $V_i=V_a/v_m$ and is inversely proportional to the volume $V_m$ of the delivery chamber 4. As is also known per se, as the volume $V_M$ of the delivery chamber 4 changes, the delivery pressure $p_m$ also changes.

As shown in the figures, the adjustment means comprise mechanical valve means 13 interposed between the compression chamber 6 and the delivery chamber 4 and configured to automatically vary the aperture of at least one discharge port 7 according to the difference in pressure existing between the delivery chamber 4 and the compression chamber 6.

In addition, the valve means 13 comprise at least one movable element 14 received in a corresponding seat 15 having an upstream portion 16 in fluid communication with the compression chamber 6 and a downstream portion 17 in fluid communication with the delivery chamber 4.

According to a peculiar aspect of the invention, the compression chamber 6 has a substantially flat end wall, transverse to the axis of rotation of the compression element 8 to define a delivery plane 9 and the seat 15 is adjacent to the delivery plane 9 for the movement of the at least one movable element 14 to instantaneously equalize the compression pressure $p_c$ with the delivery pressure $p_m$ to improve the efficiency of the compressor 1.

As shown in the figures, the delivery chamber 4 may extend in the portion of the compressor 1 between the delivery plane 9 and the second flange 5. Furthermore, both the primary discharge port 7' and the secondary discharge slits 7" are formed in the delivery plane 9 and the element 14 is movable as a result of the difference between the compression pressure $p_c$ and the delivery pressure $p_m$.

Indeed, equalization of the delivery pressure $p_m$ and the compression pressure $p_c$ is known to prevent overcompression or undercompression operation due to pressure variations required by the system, thereby maximizing the efficiency of the compressor 1.

Therefore, the two portions 16, 17 of the seat 15 will contain respective portions of the working fluid F at the compression pressure $p_c$ and the delivery pressure $p_m$ respectively Advantageously, the downstream portion 17 of the seat 15 may be in fluid communication with the delivery chamber 4 via a secondary duct 18.

The secondary duct 18 may comprise a first end 18A connected to the downstream portion 17 of the seat 15 and a second end 18*b* connected to the delivery chamber 4.

Thus, the seat 15 will be adjacent to the delivery plane 9 whereby the fluid connections with the upstream portions 16 and the downstream portions 17 allow the compression pressure $p_c$ and the delivery pressure $p_m$ to be read without errors, as shown in FIGS. 2 to 14.

Furthermore, the movable element 14 is adapted to selectively block or open the secondary discharge slits 7" of the discharge ports 7 to establish selective communication thereof with the delivery chamber 4.

In a first embodiment of the invention, as shown in FIGS. 2 to 7, the seat 15 may be a substantially cylindrical cavity with a Y axis substantially parallel to the delivery plane 9 and the movable element 14 may comprise a piston 19 that axially moves along the seat 15 and has an enlarged head 20 and a hollow shaft 21.

In particular, the seat 15 may be closed at its top by a sealing plug 22 adapted to delimit the axial sliding movement of the movable element 14.

Conveniently, the first end 18*a* of the secondary duct 18 may be placed in a location proximate to the sealing cap 22 in the downstream portion 17 of the seat 15.

In this embodiment, the secondary discharge slits 7" may be in fluid communication with the upstream portion 16 of the seat 15 via at least one passage 23 formed in the movable piston 19.

The passage 23 may be formed between the end of the shaft 21 that faces the discharge port 7 and the opposite end that faces the enlarged head 20 and is adapted to facilitate draining of the working fluid F from the compression chamber 6 to the upstream portion 16 of the seat 15 thereby causing the axial movement of the piston 19 and equalizing the delivery $p_m$ and compression $p_c$ pressures.

Figure 3:
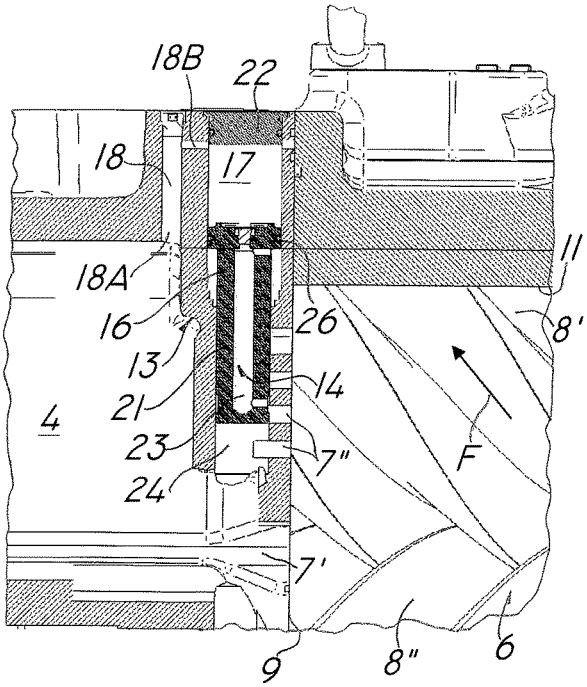
FIGS. 3 and 4 show a detail of the compressor of FIG. 2 according to a first embodiment of the automatic adjustment system in first and second operating configurations respectively.
Figure 4:
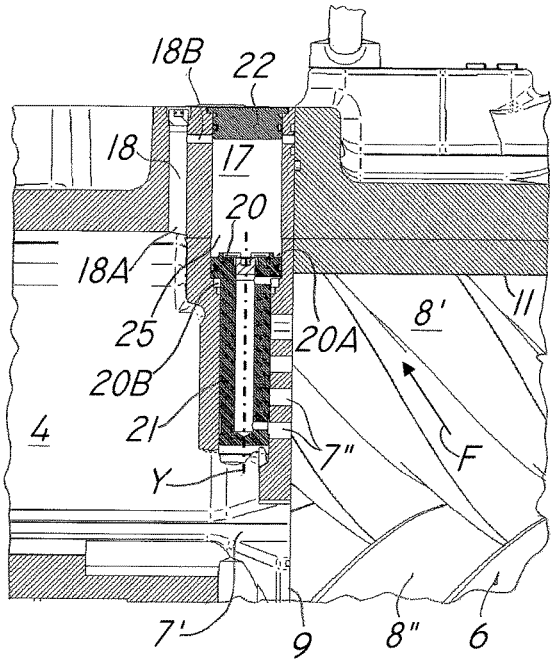
Figure 5:
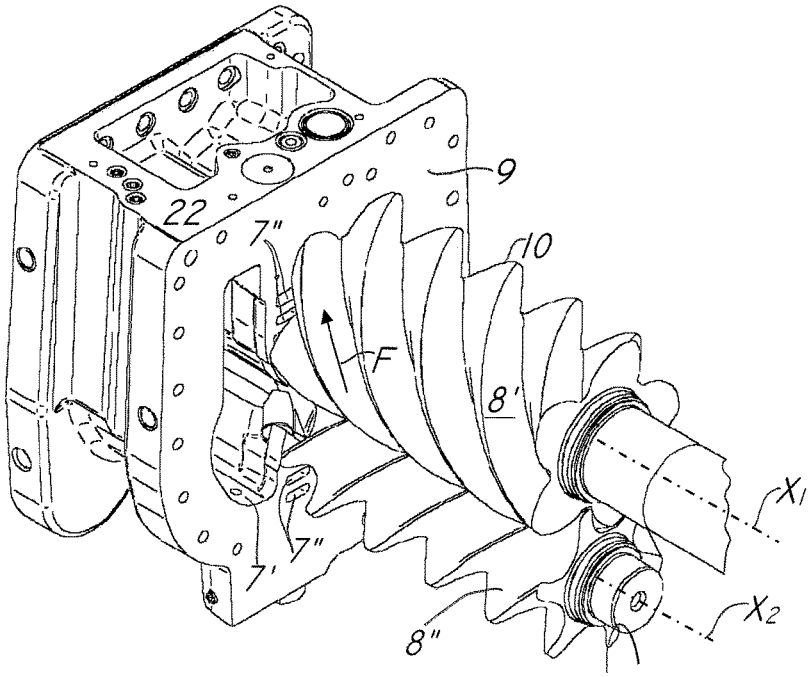
FIG. 5 is a perspective broken-away view of a detail of the positive-displacement compressor of FIG. 1 according to a first embodiment.
Figure 6:
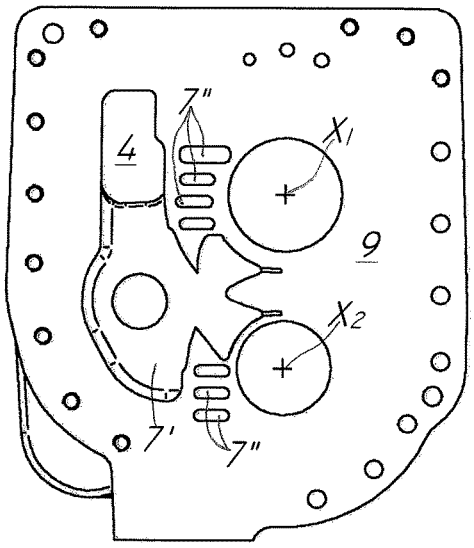
FIGS. 6 and 7 are front views of the detail of FIG. 5.

As best shown in FIGS. 3 and 4, the seat 15 may comprise a narrower part 24 for slidingly guiding the hollow shaft 21 of the piston 19 and a wider part 25 for slidingly guiding the enlarged head 20.

In particular, the wider part 25 may comprise the upstream portion 16 and the downstream portion 17 of the seat 15 and the enlarged head 20 may move between these two portions according to the pressure values therein.

The enlarged head 20 may have a first surface 20*a* that faces the downstream portion 17 and is acted upon by the delivery pressure $p_m$ required by the system and a second opposite surface 20B that faces the upstream portion 16 of the seat 15 and is acted upon by the compression pressure $p_c$.

An annular seal 26 may be placed between the first surface 20A and the second surface 20B for separating the upstream portion 16 from the downstream portion 17 of the seat 15.

Advantageously, the narrower part 24 may be in fluid communication with the delivery chamber 4 and the secondary discharge slits 7" may be adapted to be selectively connected with the narrower part 24 of the seat 15, and hence with the delivery chamber 4, through the hollow shaft 21 of the sliding piston 19.

FIG. 3 shows, by way of example, a detail of the positive-displacement compressor 1 comprising four secondary discharge slits 7" located at the male screw element 8' and three secondary slits 7" located at the female screw element 8".

This figure also shows the equilibrium operating state in which the compression pressure $p_c$ is equal to the delivery pressure $p_m$ required by the system.

Furthermore, in this equilibrium state a secondary discharge slit 7" is open and three slits 7" are closed by the hollow shaft 21 and the working fluid F compressed by screws 8', 8" is introduced into the delivery chamber 4 through the primary discharge port 7' and the open secondary slit 7".

As soon as the increasing delivery pressure $p_m$ required by the system reaches a new pressure value $p_{m2}$, the enlarged head 20 of the piston 19 moves axially as a result of the overpressure in the downstream portion 17 of the seat 15.

Thus, the shaft 21 of the piston 19 blocks the previously opened secondary discharge slit 7", as shown in FIG. 4, and moves axially along the seat 15 until it reaches a new compression value $p_{c2}$ equal to the new delivery pressure $p_{m2}$ required by the system.

Figure 7:
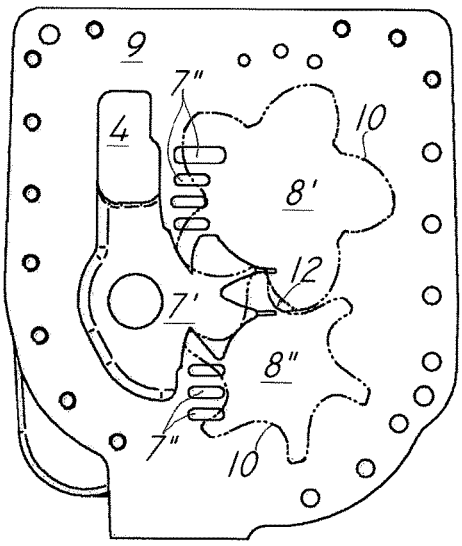

Therefore the new equilibrium state is established when the compression pressure value $p_c$ increases from the value $p_c$ to the value $p_{c2}$ due to the occlusion of the slit 7" and, as a result, by delaying the time in which the two screws 8', 8" start to discharge the working fluid F into the delivery chamber 4, as shown in FIG. 7.

With the mechanical valve means 13 interposed between the compression chamber 6 and the delivery chamber 4, the operation of the compressor 1 may be easily and automatically adapted to different working conditions in a simple and instantaneous manner.

In addition, the adjustment means may autonomously vary the compression ratio $V_i$ without the help of external control and adjustment systems and independently of any disturbance caused by the delivery pressure $p_m$ required by the system.

In a second embodiment of the invention, as shown in FIGS. 8 to 14, the compressor 1 may comprise a plurality of movable pistons 19' housed in respective seats 15 and having axes $X_3$ perpendicular to the delivery plane 9.

Each of the seats 15 may face a respective secondary discharge slit 7" and each of the pistons 19' is adapted to selectively block a respective secondary slit 7".

In this second embodiment, each movable element 14 may comprise a substantially T-shaped cross-section, with a first flat transverse section 27 facing the compression chamber 6 and acted upon by the compression pressure $p_c$ and a second flat longitudinal section 28 substantially perpendicular to the first section 27 and acted upon by the delivery pressure $p_m$ required by the system.

The transverse section 27 of these movable elements 14 corresponds to the enlarged head 20 of the piston 19' of the first embodiment whereas the longitudinal section 28 of the movable elements 14 corresponds to the shaft 21 of the piston 19' of the first embodiment.

In this embodiment a transverse gap 29 is interposed between the plurality of seats 15 and the delivery plane 9 and is adapted to establish fluid communication between the secondary discharge slits 7" and the delivery chamber 4.

Furthermore, the movable elements 14 are able to slide in respective longitudinal directions through the gap 29 to move from an operating position in which they block their respective discharge slits 7" to an idle position in which they open their respective discharge slits 7" to allow the working fluid F to flow from the compression chamber 6 to the delivery chamber 4, or vice versa.

Figure 8:
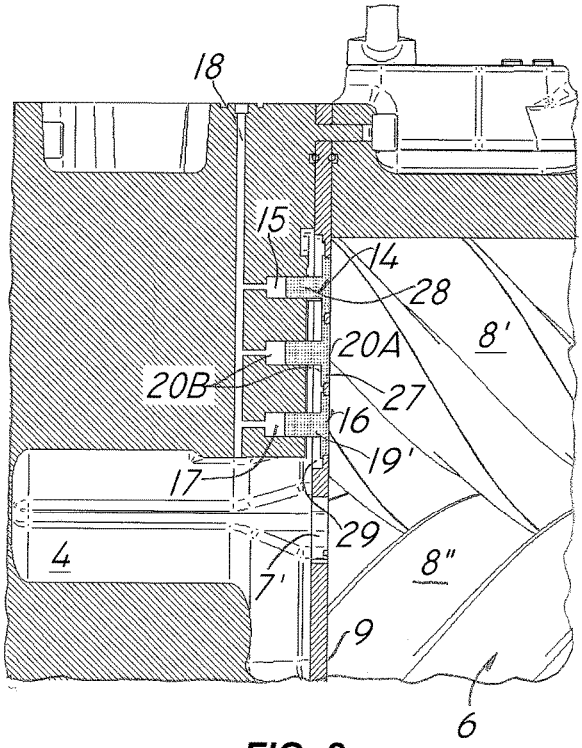
FIGS. 8 and 9 show a detail of the compressor of FIG. 1 according to a second embodiment of the automatic adjustment system in first and second operating configurations respectively.
Figure 9:
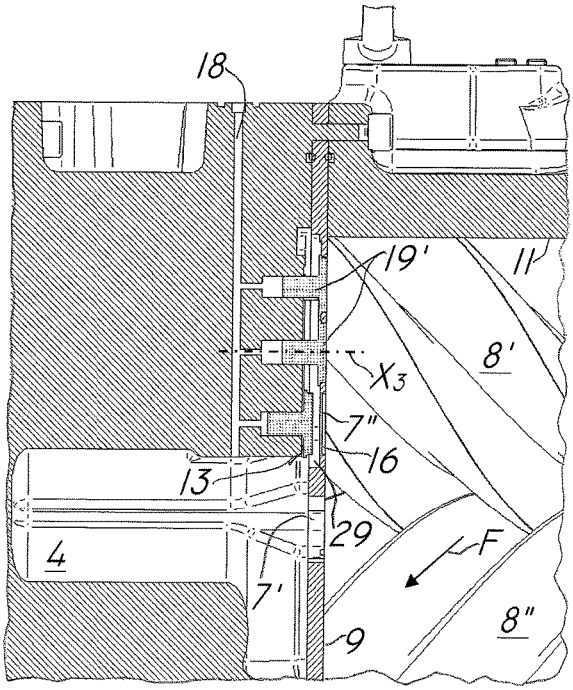

As shown in FIGS. 8 and 9, the upstream portions 16 of the seats 15 may be formed at the secondary discharge slits 7" whereas the downstream portions 17 of seats 15 may be in fluid communication with the delivery chamber 4 via a plurality of secondary ducts 18.

In addition, each seat 15 will be adapted to slidingly house a respective longitudinal section 28 of a corresponding piston 19'.

The first transverse section 27 of each piston 19' may have a first surface 20*a* facing the compression chamber 6 and a second opposite surface 20*b* facing the corresponding seat 15.

Therefore, in this embodiment, the delivery pressure $p_m$ acts both on the longitudinal portion 28 of each piston 19 housed in the respective seat 15 and on the second surface 20B of the transverse portion 27 of each piston 19 slidingly housed in the gap 29.

FIGS. 8 to 14 show, by way of example, a positive-displacement compressor 1 comprising three secondary discharge slits 7" located at the male screw element 8' and three pistons 19' housed in respective seats 15 and facing the corresponding slits 7".

Figure 10:
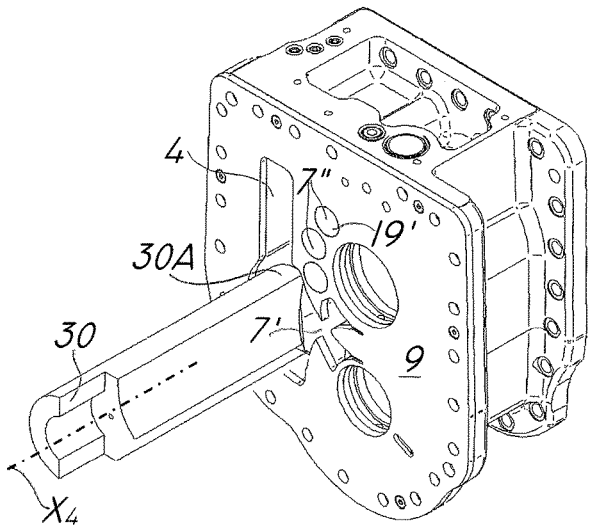
FIGS. 10 and 11 are perspective views of the detail of FIGS. 8 and 9 respectively.

In particular, FIGS. 8 and 10 show an equilibrium operating state in which the compression pressure $p_c$ is equivalent to the delivery pressure $p_m$ required by the system and in which ALL three pistons 19' block the respective discharge slits 7".

In this equilibrium state the working fluid F compressed by the screw elements 8', 8" is introduced into the delivery chamber 4 at the compression pressure of $p_c$ only through the primary discharge port 7'.

As soon as the decreasing delivery pressure $p_m$ required by the system reaches a new pressure value $p_{m3}$, the piston 19 moves longitudinally away from the compression chamber 6 as a result of the overpressure therein.

Figure 11:
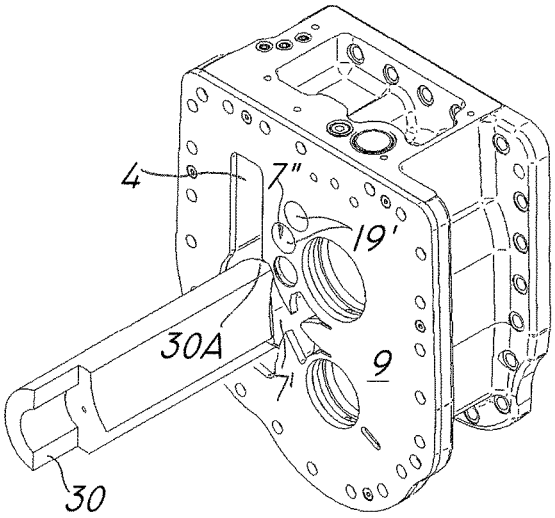
Figure 12:
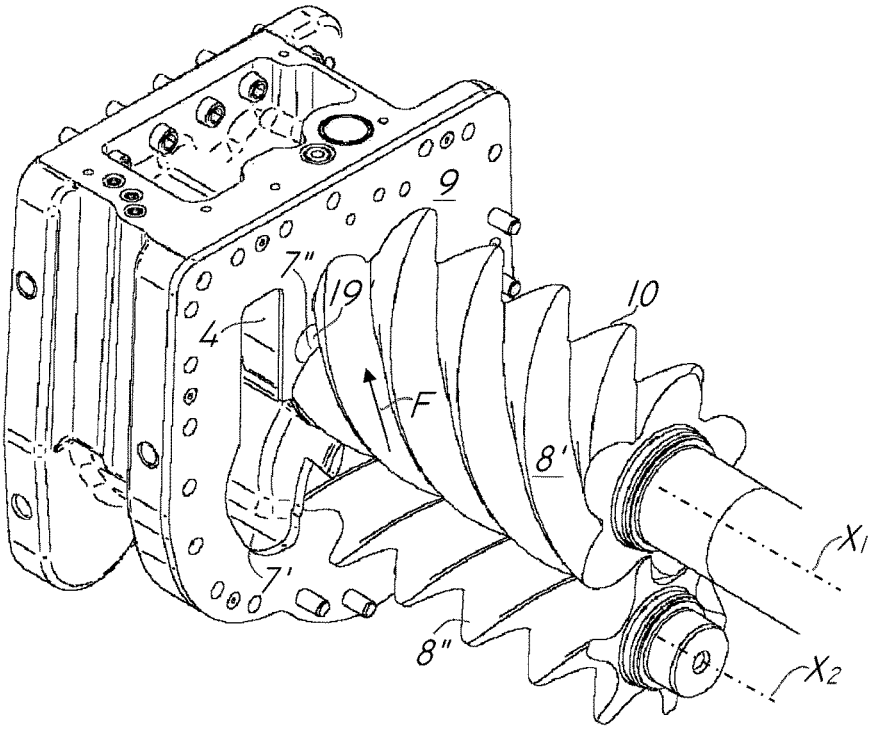
FIG. 12 is a perspective broken-away view of a detail of the positive-displacement compressor of FIG. 1 according to a second embodiment.
Figure 13:
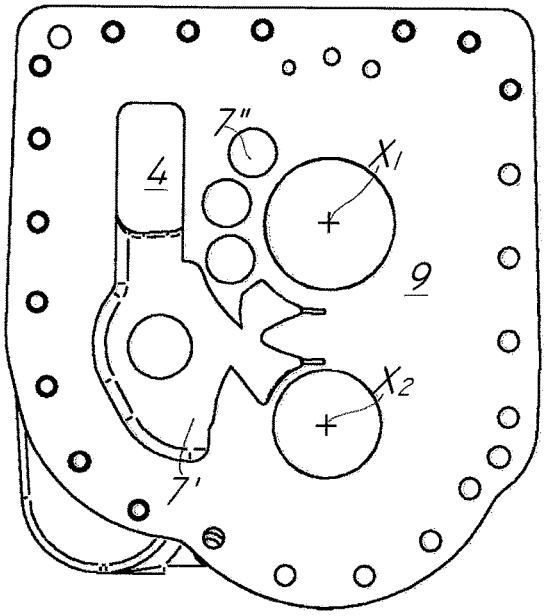
FIGS. 13 and 14 are front views of the detail of FIG. 12.

Thus, the piston 19' opens the respective previously closed secondary discharge slit 7", as shown in FIGS. 9 and 11, and moves longitudinally until it reaches a new compression value $p_{c3}$ equal to the new delivery pressure $p_{m3}$ required by the system.

Figure 14:
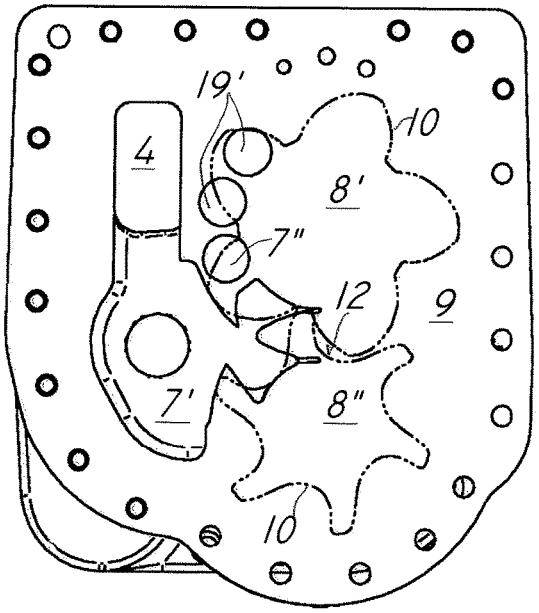

Therefore the new equilibrium state is established when the compression pressure value $p_c$ decreases from the value $p_{c1}$ to the value $p_{c3}$ due to the opening of the slit 7" and, as a result, by advancing the time in which the two screws 8', 8" start to discharge the working fluid F into the delivery chamber 4, as shown in FIG. 14.

If, the opening of the slit 7" were not enough to balance the delivery pressure $p_m$ and the compression pressure $p_c$, the next piston 19' may also move longitudinally to open a new slit 7".

As is known per se, the positive-displacement compressor 1 may comprise a slide valve 30 adapted to move along an axis $X_4$ parallel to the axis of rotation X of the compression element 8.

This slide valve 30 is moved under an external hydraulic, pneumatic or oil-hydraulic control and may comprise an end 30*a* facing the primary discharge port 7' and adapted to change the volume of working fluid to be drawn in to change the flow rate of the compressor 1.

Merely by way of example, the external control may comprise a plurality of solenoid valves, not shown, which are operably connected to a central control system and are adapted to act on the external control to cause discrete movement of the slide valve 30.

Also in this case, the above discussed mechanical valve means 13 may comprise at least one movable element 14 that moves irrespective of the size of the primary discharge port 7' to automatically and instantaneously adjust the compression ratio $v_i$.

It will be appreciated from the foregoing that the positive-displacement compressor with an automatic compression ratio-adjustment system according to the invention fulfills the intended objects and is particularly able to autonomously change the compression ratio independently of pressure perturbations in the system in which it is.

While the positive-displacement compressor has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in manufacturing factories operating in the field conditioning and refrigeration devices.

The invention claimed is:

1. A positive-displacement compressor (1) with an automatic compression ratio-adjustment system (Vi) adapted to be installed in a conditioning or refrigeration system for a working fluid (F), comprising:

a suction chamber (2) for sucking the working fluid (F) with a variable suction pressure (pa) in response to system conditions;

a delivery chamber (4) for delivering the working fluid (F) with a delivery pressure (pm) greater than said suction pressure (pa), varying in response to the system conditions;

a compression chamber (6) interposed between said suction chamber (2) and said delivery chamber (4) and in fluid communication with said delivery chamber (4) via one or more discharge ports (7);

a screw compression element (8) accommodated in said compression chamber (6) and rotating about a longitudinal axis (X) to compress the working fluid (F) to reach a compression pressure (pc);

a motor for driving said screw compression element (8); and an adjustment system adjusting compression ratio (Vi);

wherein said adjustment system comprises a mechanical valve (13) interposed between said compression chamber (6) and said delivery chamber (4) to automatically vary an aperture of said one or more discharge ports (7) in response to a difference in pressure existing between said delivery chamber (4) and said compression chamber (6);

wherein said mechanical valve (13) comprises at least one movable element (14) received in a corresponding seat (15), having an upstream portion (16) in fluid communication with said compression chamber (6) and a downstream portion (17) in fluid communication with said delivery chamber (4);

wherein said compression chamber (6) has a substantially flat end wall, transverse to an axis of rotation of said compression element (8), and defining a delivery plane (9), said seat (15) being adjacent to said delivery plane (9) for movement of said at least one movable element (14) to instantaneously equalize said compression pressure (pc) with said delivery pressure (pm) to improve compressor efficiency; and wherein said one or more discharge ports (7) comprise a primary discharge port (7') that is always open and one or more secondary discharge slits (7") that can be selectively blocked by said at least one movable element (14), said primary discharge port (7') and said one or more secondary discharge slits (7') being formed in said delivery plane (9).

2. The positive-displacement compressor as claimed in claim 1, wherein said primary discharge port (7') is directly connected to said delivery chamber (4), said downstream portion (17) of said seat (15) being in fluid communication with said delivery chamber (4) via a secondary duct (18).

3. The positive-displacement compressor as claimed in claim 2, further comprising a plurality of movable pistons (19') housed in respective seats (15) and having axes (X3) perpendicular to said delivery plane (9), each of said respective seats (15) facing a respective secondary discharge slit (7") and each of said movable pistons (19') being adapted to selectively block the respective secondary discharge slit (7").

4. The positive-displacement compressor as claimed in claim 3, further comprising a transverse gap (29) interposed between said respective seats (15) and said delivery plane (9) and adapted to establish fluid communication between said secondary discharge slits (7") and said delivery chamber (4), the upstream portions (16) of said respective seats (15) being formed at said secondary discharge slits (7") and the downstream portions (17) being in fluid communication with the delivery chamber (4) via a plurality of secondary ducts (18).

5. The positive-displacement compressor as claimed in claim 1, wherein said seat (15) is a substantially cylindrical cavity having an axis (Y) substantially parallel to said delivery plane (9), said at least one movable element (14) being a piston (19) that is designed to move axially along said seat (15), and comprising an enlarged head (20) and a hollow shaft (21).

6. The positive-displacement compressor as claimed in claim 5, wherein said one or more secondary discharge slits (7") are in fluid communication with said upstream portion (16) of said seat (15) via at least one passage (23) formed in said piston (19).

7. The positive-displacement compressor as claimed in claim 5, wherein said seat (15) comprises a narrower part (24) for slidingly guiding said hollow shaft (21) and a wider part (25) for slidingly and sealingly guiding said enlarged head (20), said wider part (25) comprising said upstream portion (16) and said downstream portion (17) of said seat (15).

8. The positive-displacement compressor as claimed in claim 7, wherein said one or more secondary discharge slits (7") are designed to be selectively connected with the narrower part (24) of said seat (15) via the hollow shaft (21) of said piston (19), said narrower part (24) being in fluid communication with said delivery chamber (4).

9. The positive-displacement compressor as claimed in claim 1, further comprising a slide valve (30) that is adapted to be moved along an axis (X4) parallel to said axis of rotation (X) under an external control, said slide valve (30) comprising one end (30A), adapted to change a size of said primary discharge port (7') to change a flow rate of the positive-displacement compressor (1), said mechanical valve (13) comprising a movable element (14) that moves irrespective of a size of said primary discharge port (7').

* * * * *